US008871659B2

(12) United States Patent
Deschamps

(10) Patent No.: US 8,871,659 B2
(45) Date of Patent: Oct. 28, 2014

(54) GROUND COVERING

(75) Inventor: Georges-Paul Deschamps, Voeuil et Giget (FR)

(73) Assignee: Ets A. Deschamps et Fils, La Couronne (FR)

( * ) Notice: Subject to any disclaimer, the term of this patent is extended or adjusted under 35 U.S.C. 154(b) by 1309 days.

(21) Appl. No.: 12/298,309

(22) PCT Filed: Apr. 25, 2007

(86) PCT No.: PCT/EP2007/054078
§ 371 (c)(1),
(2), (4) Date: Jan. 12, 2009

(87) PCT Pub. No.: WO2007/122257
PCT Pub. Date: Nov. 1, 2007

(65) Prior Publication Data

US 2010/0282360 A1 Nov. 11, 2010

(30) Foreign Application Priority Data

Apr. 25, 2006 (FR) ..... 06 51464

(51) Int. Cl.
*D03D 13/00* (2006.01)
*E01C 9/08* (2006.01)
*D03D 23/00* (2006.01)

(52) U.S. Cl.
CPC . *E01C 9/08* (2013.01); *D03D 23/00* (2013.01)
USPC ..... 442/203; 442/2; 442/49; 442/182; 442/184; 442/185

(58) Field of Classification Search
USPC ..... 442/2, 49, 182, 184, 185, 203
See application file for complete search history.

(56) References Cited

U.S. PATENT DOCUMENTS

| | | | | |
|---|---|---|---|---|
| 5,846,890 | A * | 12/1998 | Deschamps | 442/203 |
| 5,965,467 | A | 10/1999 | Stevenson et al. | |
| 6,696,122 | B1 * | 2/2004 | Deschamps | 428/36.1 |
| 6,955,192 | B2 * | 10/2005 | Matsui et al. | 139/384 R |
| 2002/0148525 | A1 | 10/2002 | Matsui et al. | |
| 2005/0279470 | A1 * | 12/2005 | Redd et al. | 162/109 |

FOREIGN PATENT DOCUMENTS

| | | | |
|---|---|---|---|
| EP | 0235853 | A1 | 9/1987 |
| EP | 0748404 | B1 | 12/1998 |

OTHER PUBLICATIONS

International Search Report dated Aug. 7, 2007.

* cited by examiner

*Primary Examiner* — Andrew Piziali
(74) *Attorney, Agent, or Firm* — Perman & Green, LLP

(57) ABSTRACT

A temporary ground covering for displacement on sandy, muddy or boggy ground. The covering includes a woven structure formed of warp and weft. The weave is such that each warp thread interlaces with the weft thread, following approximately half the intersections of the rows and columns of the weave. The warp thread is left in the remaining intersections for each warp thread to obtain at least one simple tight weave area followed by an area of floats. The alternation of the different areas causes contractions of the weft thread creating a significant relief of the obtained fabric. The covering includes flat threads over at least one part of the width of the woven structure on at least one of the surfaces. Each thread is taken, steadily or not, by weft threads placed at the end of the projections of the woven surface structure.

16 Claims, 5 Drawing Sheets

GROUND COVERING

CROSS-REFERENCE TO RELATED APPLICATIONS

This application is the National Stage of International Application No. PCT/EP2007/54078, International Filing Date 25 Apr. 2007, which designated the United States of America and which International Application was published under PCT Article 21 (2) as WO Publication No. WO 2007/122257 and which claims priority to French Application No. 0651464, filed on 25 Apr. 2006, the disclosures of which are incoporated herein by reference in their entirety.

BACKGROUND

The disclosed embodiments relate to a temporary ground covering, in particular to enable or facilitate the movement of people and/or machines over sandy or boggy ground.

Temporary covering structures are known for this type of ground, which are likely to be deployed on the surface of the ground to enable machines to circulate, for example.

FIG. 1 diagrammatically shows a partial profile view of such a covering structure of the prior art. This structure, which has been described by the present applicant in the patent application WO 95/26435, comprises a woven structure 1 formed from weft thread 2 of the single-thread type arranged in a single layer and warp threads 3 also arranged in a single layer.

The weave of the woven structure is such that each warp thread 3 interlaces with the weft threads 2 following, preferably and very approximately, half the intersections of the rows and columns of the weave, the warp threads 3 being sunk in the remaining intersections, in order, for each warp thread 3, to obtain at least one simple tight weave area 4 followed by an area of floats 5.

The alternation of the tight interweaving areas 4 and the areas where the warp threads do not work 5 causes contractions of the weft threads 3 creating on the two surfaces of the fabric a ribbed crimped structure.

The drive wheels or tracks of the vehicles moving on the surface of the covering structure offer good adhesion to these reliefs, thus conferring on these vehicles an advantageously high speed of movement.

These reliefs also ensure a good attachment of the structure itself to the duly covered grounds.

This attachment, combined with the flexibility of the covering structure which enables it to hug the profile of the ground to be covered, prevents any movement of the structure under the weight of the machines circulating on its surface and the formation of ruts.

More generally, the implementation of such a covering structure makes it possible to protect the ground from any erosion associated with the stamping of feet or with the passage of machinery.

This covering structure, which consequently gives excellent results for the circulation of machines over ground offering low cohesion or unstable ground, can nevertheless be further improved.

It has in fact been observed that the significant reliefs of this structure form an uneven surface which, combined with its rigidity, makes movement on its surface with bare feet difficult.

In certain cases, such bare-footed movement can lead to the appearance of contusions on the feet.

Also, a certain disaffection with these structures is observed among beach attendants inconvenienced by the relief and the rigidity of said structures, the latter then preferring to move directly over the sand.

It would therefore be advantageous to adapt these covering structures to facilitate the bare-footed movement of pedestrians but also of machines provided with small wheels, such as strollers. The latter are in effect also sensitive to the unevenness of the surface of the covering structure.

Moreover, these covering structures feature a lot of openwork to ensure a total flow of water. They therefore do not allow graphics or messages to be printed on their surfaces.

Now, it would be beneficial to use these structures as information or advertising supports at events such as sporting or promotional shows.

Finally, these covering structures can blend with the ground, for example, on snow-covered ground when they are white, or can be very slightly visible for a vehicle moving in the dark.

The risk of a poor engagement of the vehicle on such a ground covering structure or of the departure of this vehicle from this structure being probable, the vehicle can at any time be immobilized.

It is then necessary to beacon the traffic channel or channels defined by the ground covering structure, which requires additional means and the immobilization of operators.

It would therefore be beneficial to have a ground covering structure incorporating its own beaconing to indicate its lateral ends and allow circulation at high speed on its surface in difficult traffic conditions.

SUMMARY

The aspects of the disclosed embodiments provide a ground covering structure, simple in its design and in how it is used, light and flexible and allowing bare-footed movement on its surface while retaining a very good attachment of the covering to the ground.

Another aspect of the disclosed embodiments is to provide a covering structure that can be expanded on the surface of a beach which allows both the bare-footed movement of people and the movement of machines, such as wheelchairs for handicapped people and the towing of personal water craft.

To this end, the disclosed embodiments relate to a temporary ground covering in particular for movement over sandy, muddy or boggy ground, comprising a woven structure formed by warp threads arranged in a single layer and weft threads also arranged in a single layer, the weave of said woven structure being such that each warp thread interlaces with the weft threads following, preferably and very approximately, half the intersections of the rows and columns of the weave, the warp thread being sunk in the remaining intersections, in order, for each warp thread, to obtain at least one simple tight weave area followed by an area of floats, the alternation of the different above-mentioned areas causing contractions of the weft threads, creating a significant relief of the duly obtained fabric.

According to the disclosed embodiments, this covering comprises flat threads arranged over at least one part of the width of the woven structure and on at least one of its surfaces, each of these flat threads being linked, evenly or not, by weft threads placed at the ends of the projections of said woven structure surface.

"Riser" should be understood to mean the link between the flat thread and the original structure. From a point of view of the weave of the inventive ground covering, this is reflected in a sinker.

"Flat thread" should be understood to mean a product extruded through a thread-guide, drawn or other, of which the full and substantially constant transverse section over its entire length is of oval, square, rectangular, flattened circular and modified square or rectangular shape, that is, having two opposing sides having a convex arc form, the other two being straight, equal and parallel. These flat threads could even be hollow and, by way of illustration, present a flattened tubular cross section.

This internal hollow area of the flat thread constitutes a recess that can receive one or more elongated objects such as a heating element. By linking these heating elements to an external energy source, it thus becomes possible to melt, as an example of implementation, ice or snow present on the traffic channel defined by the temporary ground covering. The range of temperatures of the heating element is, of course, located below a temperature likely to damage the threads that form the covering. The maximum temperature is thus less than, for example, 80° C.

Preferably, the flat thread is then produced in a material that is a good thermal conductor such as a metal material, to minimize the losses of thermal radiation generated by the heating element.

At least some of the flat threads of the ground covering can be flat threads sending and/or receiving a signal. They can thus, purely by way of illustrative example, be antennas that can pick up electromagnetic waves but that can also send such waves. By linking the end of these flat threads to a line transporting the signal such as a coaxial cable, the signal picked up by the antenna can be directed to the input of a receiver or, in the reverse direction, a signal supplied by an external sender can be directed to the ground covering.

These flat threads can even be of different dimensions to form an array of antennas sending in different frequency ranges.

These flat threads can thus be used, for example, to send geolocation signals from the inventive ground covering for the attention of a helicopter in operation in difficult weather conditions. These signals sent by the covering can enable the pilot, despite reduced visibility, to remotely locate the ground covering and land on its surface.

"Preferably and very approximately" should be understood to mean an equal amount of risers and sinkers of each warp thread which is not absolute but which, on the contrary, can deviate therefrom by 10 to 15% for example, or even more, given that the greater the departure from a strictly equal amount, the more the machine will require adjustments.

The flat threads can have a length that is substantially equal to that of the woven structure or a length that is less than the latter. Their length is, however, greater than 3 evolutions of the weave of the woven structure.

More generally, the aspects of the disclosed embodiments therefore relate to a temporary ground covering comprising a woven structure formed by warp thread arranged in a single layer and weft thread also arranged in a single layer, said woven structure comprising first weft threads placed above or below second weft threads defining a main plane, said first weft threads thus forming projections in the woven structure, characterized in that it comprises flat threads arranged over at least one part of the width of said woven structure on at least one of its surfaces, each of said flat threads being linked, evenly or not, by weft threads placed at the ends of the projections of said woven structure surface.

In different particular embodiments of this temporary ground covering, each having its particular advantages and open to numerous possible technical combinations:

each flat thread is linked only by the outermost weft threads of said woven structure, there is thus avoided any penetration of the flat threads into the woven structure to best cover surface unevenness and form a smooth outer surface.

These outermost weft threads of the woven structure are, of course, to be considered not relative to all the projections of the woven structure, but locally, at the level of the projection in which the flat thread is inserted.

the flat threads are parallel and spaced apart from each other, this embodiment advantageously makes it possible to retain a flow of water and therefore a significant permeability of the ground covering. It also allows for the passage of particles (dust, grains of sand or earth, etc.), leaving the surface of the covering substantially clean.

the flat threads are at least partly pressed against said woven structure between two risers, the flat threads are linked every n weft threads of said woven structure, n being ≥8, advantageously, the number n corresponds to the number of weft threads present in an evolution of the weave.

each flat thread being placed between two warp threads serving as guide, the flat threads have a height less than or equal to the diameter of these warp threads, the flat thread is parallel to these two warp threads, the latter gripping the flat thread over at least one part of its length by serving as a guide for it.

the flat threads are produced in a material chosen from the group consisting of polyesters, polyamides, polypropylenes, and polyethylenes, these materials confer a rot-proof character on the duly formed temporary ground covering, and a resistance to ultraviolet (UV) radiation. Advantageously, the flat threads can even be produced in biodegradable materials such as a biodegradable plastic material, or even in an oxidegradable plastic material. The biodegradable plastic material can be starch-based.

With the covering being produced fully in one of these biodegradable or oxidegradable plastic materials, or in a combination of these materials, it thus has the faculty of being self-destructive in a few weeks or a few months depending on the diameter of the warp and weft threads and the thickness of the flat threads used.

at least some of the flat threads comprise a highly reflective coating to reflect the light emitted by the machines moving over the covering and form a light guide, by having these flat threads on the lateral edges of the covering, the machines circulating on its surface can more easily identify the track for movement in difficult conditions such as the dark, fog, showers, etc. According to one variant, the flat threads can be photoluminescent.

at least some of said flat threads are able to send and/or receive signals, the aspects of the disclosed embodiments also relate to the use of the covering as described previously as a support for at least one temporary habitation on sandy, boggy or snow-covered ground.

The presence of these flat threads on the surface of the woven structure advantageously makes it possible to reduce the imprint of the temporary covering on a deformable surface such as a tent mat.

The ground coverings of the disclosed embodiments also make it possible to add a thermal insulation by forming a screen between the ground of the temporary habitation of tent type and the natural ground.

BRIEF DESCRIPTION OF THE DRAWINGS

The disclosed embodiments will be described in more detail with reference to the appended drawings in which.

DETAILED DESCRIPTION OF THE DISCLOSED EMBODIMENTS

Figure 2:
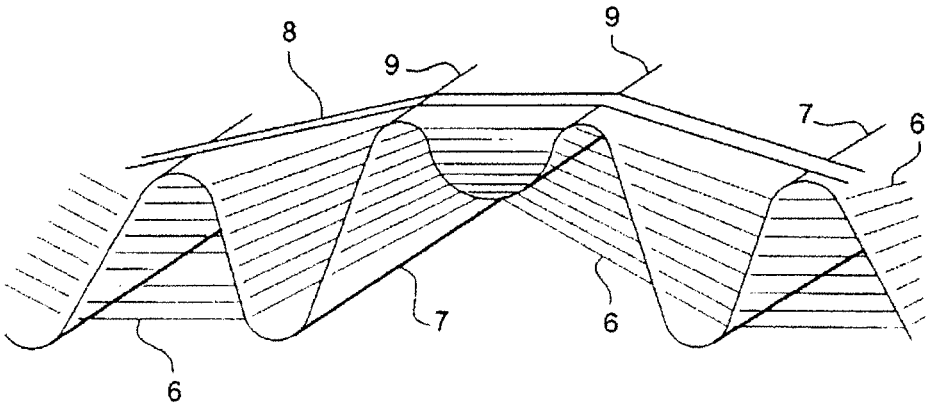
FIG. 2 is a diagrammatic representation of a temporary ground covering according to a first embodiment.

FIG. 2 shows a temporary ground covering notably for movement over sandy, muddy or swampy ground according to one embodiment.

This covering comprises a woven structure formed by warp thread 6 arranged in a single layer and weft thread 7 also arranged in a single layer. These warp 6 and weft 7 threads are preferably single-thread in order to provide the woven structure with the necessary rigidity. However, the warp threads can be single-thread or not.

The weft threads 7 can, for example, have a diameter of the order of 30 to 200 hundredths of a millimeter. The warp threads 6 preferably have a diameter slightly less than that of the weft threads 7. As a purely illustrative example, the weft threads 7 have a diameter of 80 hundredths of a millimeter and the warp threads 6 have a diameter of 65 hundredths of a millimeter.

The warp 6 and weft 7 threads are advantageously produced in a material chosen from the group consisting of polyesters, polyamides, polypropylenes, starch-based biodegradable plastic materials, oxidegradable plastic materials and polyethylenes.

The weave of this woven structure is such that each warp thread 6 interlaces with the weft threads 7 following, preferably and very approximately, half the intersections of the rows and columns of the weave, the warp thread 6 being sunk in the remaining intersections, in order, for each warp thread, to obtain at least one simple tight weave area followed by an area of floats, the alternation of the different above-mentioned areas using contractions of the weft threads 7, creating a significant relief of the duly obtained fabric. For a more detailed description of such a woven structure, reference can be made to the patent application WO 95/26435.

This temporary ground covering therefore presents on its two surfaces a crimped structure with transversal ribs formed by projections and hollows, which confer on the covering its adhesion properties for tires and treads of vehicles required to move over this covering.

The covering comprises on one of its surfaces flat threads 8 arranged over one part of the width of the woven structure, thus generating a portion having a soft profile that is particularly suited to walking barefoot and another portion having a significant relief suited to the movement of vehicles.

Each flat thread 8 is only linked by the outermost weft threads 9 of the woven structure on the corresponding surface, which makes it possible to cover as much as possible the hollows of the woven structure while minimizing the penetration of these flat threads 8 into the woven structure. The covering thus retains its qualities of attachment to the ground.

The flat threads 8 can all be linked by the same weft thread 7 or, on the contrary, by different weft threads 7 in order to provoke an offset of their link, thus favoring the softness of the surface.

These flat threads 8 are parallel and spaced apart from each other to provide the covering with significant permeability. At the same time, they constitute a barrier limiting the ingress of foreign bodies into the woven structure.

To prevent the flat threads 8 from being able to move transversely over the woven structure, each flat thread 8 is placed between two consecutive warp threads 6 serving as guides for this flat thread 8.

The flat threads 8 then preferably present a height, or thickness, that is less than the diameter of these warp threads 6 so as to keep these flat threads 8 captive.

As a purely illustrative example, the warp threads 6 having a diameter of 65 hundredths of a millimeter, the flat threads 8 present a height of 42 hundredths of a millimeter.

Moreover, the flat threads 8 are stretched so as to be at least partly pressed against the woven structure between two catches to prevent a possible gripping of this flat thread and the application to the latter of a high stress, for example by traction.

These flat threads 8 are preferably produced in polyester for outdoor applications, but they can also be produced in a material chosen from the group consisting of polyamides, polypropylenes, polyethylenes and biodegradable or oxidegradable plastic materials.

For sandy ground-covering applications for example, these flat threads 8 can be previously covered by an antimicrobial agent before the covering is woven.

The flat threads can also serve as a support for information or advertising. For this, they comprise at least one printed surface.

To make such a covering, a support previously printed by a method known to those skilled in the art can be cut into tapes of uniform width, for example 3.5 mm. These tapes or flat threads 8 are then joined together and these duly joined tapes 8 are wound on a thread storage system.

This thread storage system is then installed on a shuttle loom used to make the woven structure. This shuttle loom preferably comprises its own independent feed system for warp 6 and weft 7 threads. The shuttle loom is thus capable of receiving a sheet of threads not having the same take-up as that of the woven structure.

The woven structure is made by incorporating the printed tapes. The shuttle loom comprises a sensor linked to a processing unit. This processing unit sends control signals to a cutting tool to determine the length of the flat thread 8, or tape, to be inserted. It is thus possible to be sure not to damage the pattern by cutting the tapes joined into a strip in the wrong places.

With the flat threads 8 being spaced apart from each other by a short distance, for example, d between 3 and 5 mm, +/−10%, the pattern of the previously printed information support can be found on the ground covering.

Obviously, the printing of the flat threads can be carried out by any other known method and after the temporary ground covering has been made so as to insert the advertising or information message on request.

The flat threads 8 can even comprise at least one protection layer arranged on at least one of their external surfaces, after the advertising or information message has been printed to protect the printed surface or surfaces from external attacks.

The woven structure described hereinabove can finally be linked to an auxiliary woven structure comprising a sheet of warp threads and a sheet of weft threads. The woven structure is then superimposed on this auxiliary woven structure and the link between these two woven structures is produced so as to constitute between the two structures, from place to place, tubular pockets oriented along the warp threads 6 or along the weft threads 7.

The pockets are produced from place to place, at regular or irregular intervals. They can serve as a recess for receiving items added for various purposes.

Thus, the pockets can receive, at the time of weaving, or later, a rigidifying elongate element, such as a bar for example made of composite material and measuring a few tens of millimeters in diameter.

The bars, for example of glass fiber and polyester resin type and 25 mm in diameter, are kept captive in the pockets between the two woven structures and confer on the covering an enhanced lift while reinforcing the projecting character of the areas where these bars are inserted.

The nature and the diameter of the threads of the auxiliary woven structure can, of course, vary, depending on the planned applications.

For a description of the auxiliary structure and of the linking of these woven structures, reference can be made to the patent application WO 99/49116 filed by the present applicant.

Figure 1:
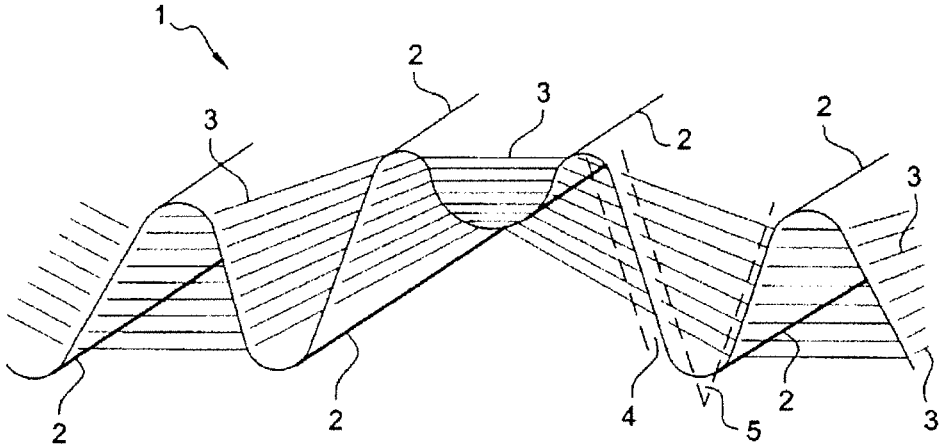
Fig. 1 Prior Art
FIG. 1 diagrammatically represents a partial view of a covering structure of the prior art.
Figure 3:
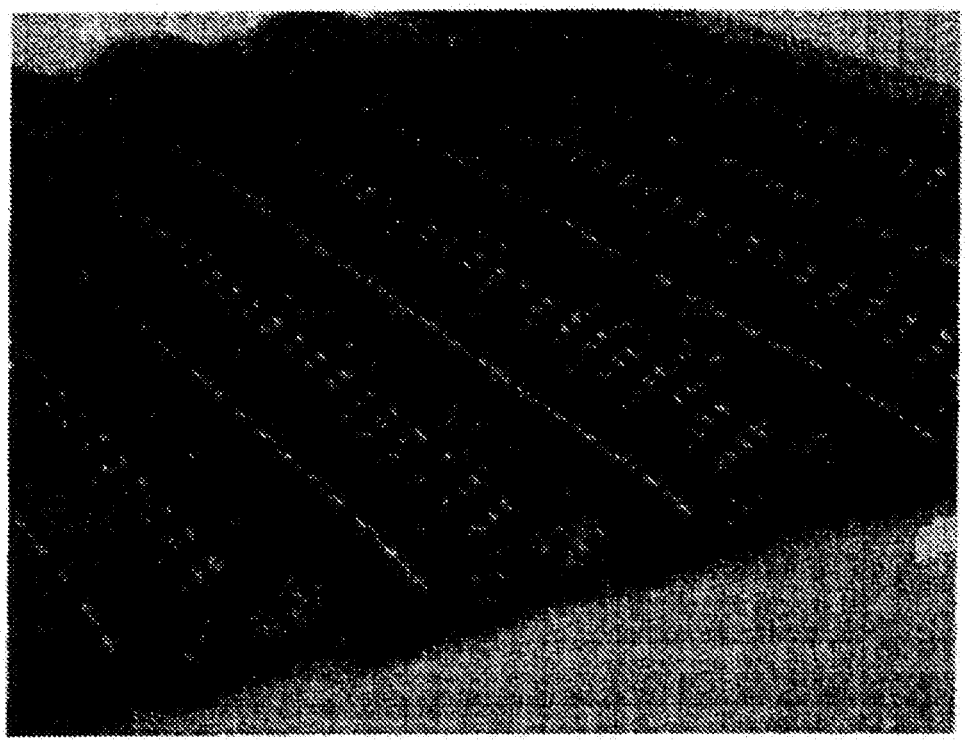
FIG. 3 is a profile view of a ground covering according to a second embodiment.
Figure 4:
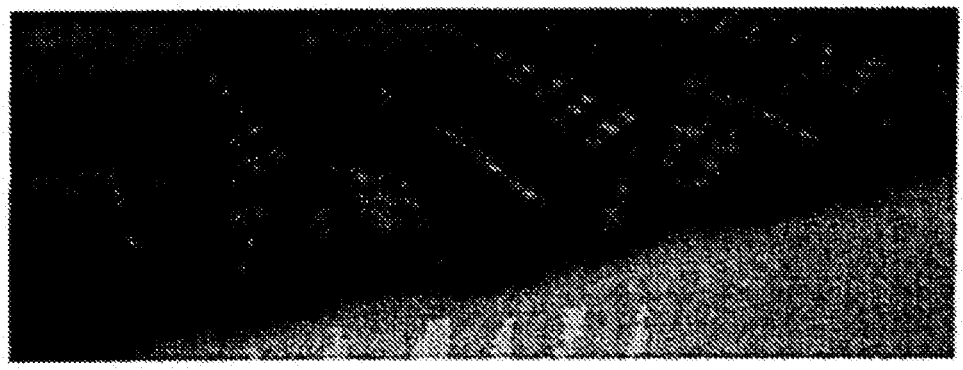
FIG. 4 is an enlarged view of the ground covering of FIG. 3 showing how each flat thread is inserted into the covering structure of FIG. 1.

FIGS. 3 and 4 show a ground covering according to a second embodiment of the disclosed embodiments The weft threads 7, warp threads 6 and flat threads 8 having been described previously, we will now set about describing hereinafter the way in which each flat thread 8 is inserted into the covering structure of FIG. 1.

The flat threads 8 are identical and linked by one and the same weft thread 7 over the width of the ground covering. Each flat thread is also regularly inserted into a woven structure of the type of FIG. 1.

FIG. 4 notably shows that, to prevent the flat threads 8 from being able to move transversely on the woven structure, each flat thread 8 is surrounded either side of its lateral edges by at least one warp thread 6, serving as a guide for this flat thread 8. The flat threads 8 are, moreover, pressed against the woven structure.

Figure 5:
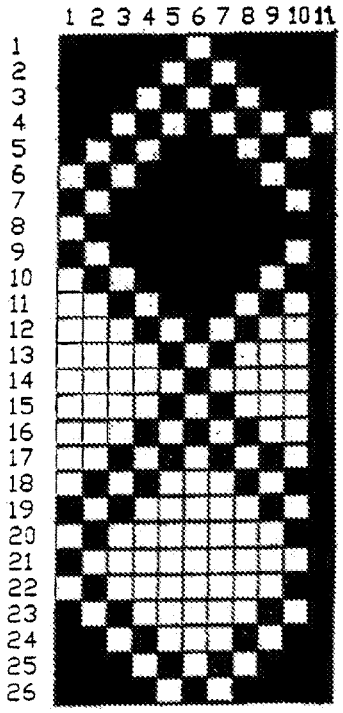
FIG. 5 represents the weave of the ground covering of FIG. 3.

FIG. 5 represents the weave of the ground covering of FIG. 3. This weave, represented conventionally, comprises ten warp threads, numbered 1 to ten, facing 10 vertical columns and 26 weft threads, numbered 1 to 26, facing 26 rows for the woven structure in which the flat threads are inserted. An eleventh vertical column represents the flat threads inserted identically into the woven structure of FIG. 1. Facing this eleventh column there is therefore placed a flat thread numbered 11.

At the intersections of the rows and columns are shown, in the known manner, in black, the riser warp threads or flat thread and, in white, the sinker warp threads or flat thread in the remaining intersections.

Figure 6:
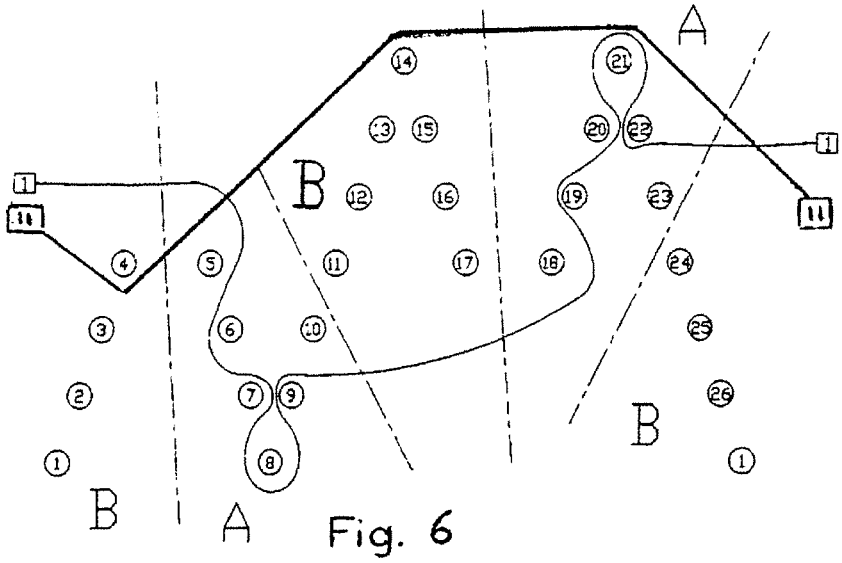
FIG. 6 diagrammatically shows the weave of FIG. 5 reduced to the weft thread, the warp thread no. 1 and the flat thread.

Thus, for example, by considering FIGS. 5 and 6, it can be seen that the woven structure in which the flat threads are inserted, the warp thread no. 1 passes successively over the first five weft threads (no. 1 to 5), then passes under the weft thread no. 6, passes again over the weft thread no. 7, then under the weft thread no. 8, then over no. 9, then passes under no. 10 to 18, then over no. 19, under no. 20, over no. 21, under no. 22 and finally over no. 23 to 26.

In all, the warp thread no. 1 has thirteen risers and thirteen sinkers.

Moreover, as can be better seen in FIG. 6, the warp thread no. 1 interlaces with the weft threads (numbered 1 to 26) according to a simple, tight weave of gauze type, in two areas designated A each preceded and followed by an area called B where the warp thread is sunk. Each area A or B covers several consecutive weft threads.

There can consequently be seen, for each warp thread of the weave of FIG. 5, an alternating succession of areas A (gauze type weave) and B (sunk warp threads), the number of areas A and of areas B possibly varying from one warp thread to another.

The alternation of the tight interweaving areas A and of areas B where the warp threads do not work and therefore create large floats, causes contractions of the weft threads creating a significant relief of the woven structure into which are inserted the flat threads as shown in FIGS. 3 and 4.

The flat thread, for its part, is linked only once by the weft thread no. 4 generating a sinker on the weave of the ground covering. The flat thread therefore evolves above the weft threads no. 1 to 3 and 5 to 26.

Figure 7:
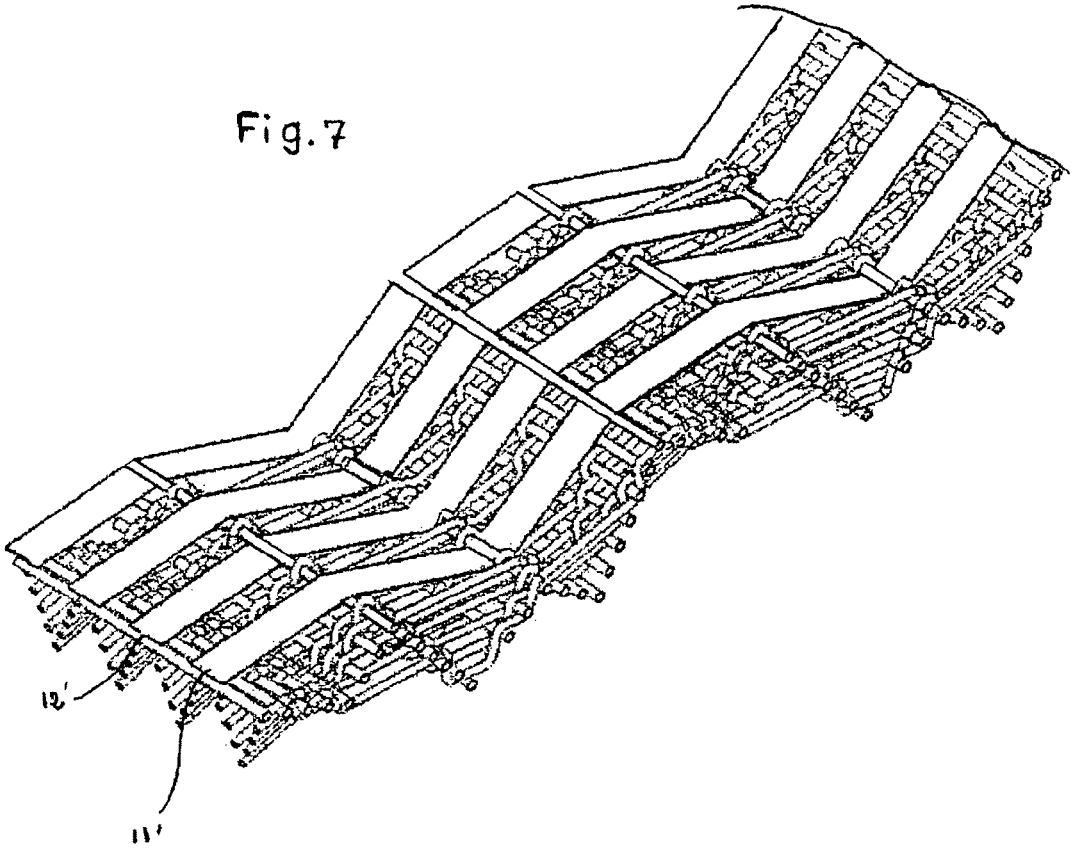
FIG. 7 is a profile view of a ground covering according to a third embodiment.
Figure 8:
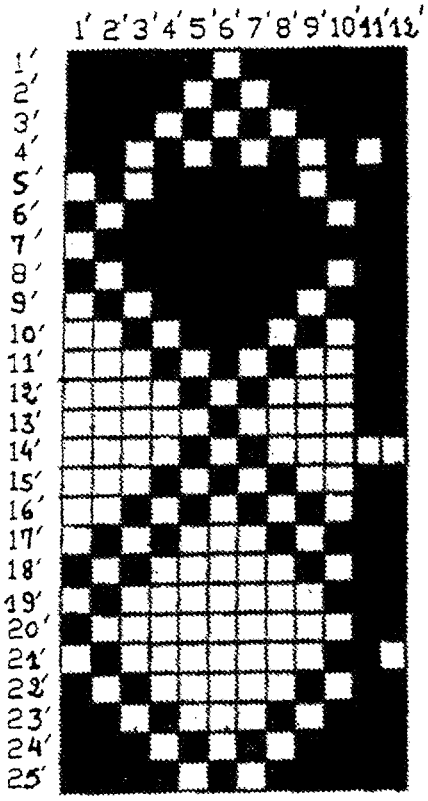
FIG. 8 represents the weave of the ground covering of FIG. 7.

FIG. 7 shows a profile view of a ground covering according to a third embodiment and FIG. 8 is a diagrammatic representation of the weave of this ground covering.

This ground covering presents an alternation of two flat threads numbered 11' and 12' inserted differently into a basic woven structure.

The basic woven structure in which there are inserted, as and when required, during its production, flat threads to obtain the ground covering of the disclosed embodiments, comprises 25 weft threads and 10 warp threads in one evolution of its weave.

The weave of the ground covering therefore comprises twelve vertical columns facing which are placed the warp threads, numbered 1' to 10' of the basic woven structure and the two flat threads numbered 11' and 12'. The weave comprises 25 weft threads, numbered 1 to 25, facing 25 rows for the basic structure in which are inserted the flat threads.

Looking at FIG. 7, it can be seen that the flat thread 11' is linked twice, which is reflected in FIG. 8 by two sinkers for one evolution of the weave. According to FIG. 8, it passes successively over the first three weft threads (no. 1' to 3'), then passes under the weft thread no. 4', passes again over the weft threads no. 5' to 13', then under the weft thread no. 14', then passes again over the weft threads no. 15' to 25'.

In FIG. 7, the flat thread 11' is therefore linked by the weft threads 4' and 14'.

Looking at FIG. 7, it can be seen that the flat thread 12' has two risers, which is reflected in FIG. 8 by two sinkers for one evolution of the weave. In FIG. 8, the flat thread 12' passes successively over the first 13 weft threads (no. 1' to 13'), then passes under the weft thread no. 14', passes again over the weft threads no. 15' to 20', then under the weft thread no. 21', then passes again over the weft threads no. 22' to 25'.

The result is that, between the weft threads 4' and 14', the flat thread 12' is horizontal, thus covering the hollow of the basic woven structure and conferring a flat aspect on this area seen from outside the ground covering.

What is claimed is:

1. A temporary ground covering comprising a woven structure formed by warp threads arranged in a single layer and weft threads also arranged in a single layer, said woven structure comprising first weft threads placed above or below second weft threads defining a main plane, said first weft threads thus forming protrusions in the woven structure, wherein the woven structure comprises flat threads arranged on at least one part of a width of said woven structure on at least one face of the woven structure, wherein each of said flat threads are linked, regularly or not, by weft threads at ends of the protrusions of said woven structure.

2. The covering as claimed in claim 1, wherein each of said flat threads is linked only by the outermost weft threads of said woven structure.

3. The covering as claimed in claim 1, wherein said flat threads are parallel and spaced apart.

4. The covering as claimed in claim 1, further comprising that each of said flat threads is at least partly pressed against said woven structure between two risers.

5. The covering as claimed in claim 1, wherein said flat threads have a hollow transverse section.

6. The covering as claimed in claim 1, wherein said flat threads are linked every n weft threads of said woven structure, n being ≥8.

7. The covering as claimed in claim 1, further comprising each flat thread being placed between two warp threads serving as guide, said flat threads have a height less than or equal to the diameter of said warp threads.

8. The covering as claimed in claim 1, further comprising that the weft threads have a diameter of the order of 30 to 200 hundredths of a millimeter and the warp threads have a diameter less than that of the weft threads.

9. The covering as claimed in claim 1, wherein said flat threads are made of a material selected from the group comprising polyesters, polyamides, polypropylenes, polyethylenes and biodegradable or oxydegradable plastic materials.

10. The covering as claimed claim 1, wherein at least some of said flat threads comprise a reflective coating to reflect light emitted by machines moving over said covering and to form a light guide.

11. The covering as claimed in claim 1, further comprising that said flat threads are covered by an antimicrobial agent.

12. The covering as claimed in claim 1, further comprising that it comprises an auxiliary woven structure comprising a sheet of warp threads and a layer of weft threads, said woven structure being superposed on said auxiliary woven structure and the link between the two woven structures being created so as to constitute between the two structures, from place to place, tubular pockets oriented according to the warp threads or weft threads, said pockets serving as housings to receive elements fitted for various purposes.

13. The covering as claimed in claim 1, further comprising that at least some of said flat threads are able to emit and/or receive signals.

14. The covering as claimed in claim 1, wherein said flat threads comprise at least one printed surface.

15. The covering as claimed in claim 14, wherein said flat threads comprise at least one protective layer to protect said printed face from external attack.

16. The use of said covering according to claim 1, as a support for at least one temporary habitation on sandy, marshy or snowy ground.

* * * * *